US008216251B2

(12) United States Patent
Julemont

(10) Patent No.: US 8,216,251 B2
(45) Date of Patent: Jul. 10, 2012

(54) MONOLITHIC EPILATOR

(75) Inventor: Pierre Julemont, Argenteau (BE)

(73) Assignee: Faco S.A., Wandre (BE)

( * ) Notice: Subject to any disclaimer, the term of this patent is extended or adjusted under 35 U.S.C. 154(b) by 529 days.

(21) Appl. No.: 12/299,729

(22) PCT Filed: May 14, 2007

(86) PCT No.: PCT/BE2007/000046

§ 371 (c)(1),
(2), (4) Date: Nov. 5, 2008

(87) PCT Pub. No.: WO2007/134409

PCT Pub. Date: Nov. 29, 2007

(65) Prior Publication Data

US 2009/0076524 A1 Mar. 19, 2009

(30) Foreign Application Priority Data

May 18, 2006 (EP) ..... 06447067

(51) Int. Cl.
*A61B 17/50* (2006.01)

(52) U.S. Cl. ..... 606/133

(58) Field of Classification Search ..... 606/9, 32, 606/33, 43, 131, 133, 169, 187, 210; 452/75, 452/82, 94, 104; 604/289, 46; 132/73.6, 132/75.4–75.6

See application file for complete search history.

(56) References Cited

U.S. PATENT DOCUMENTS

| | | | | |
|---|---|---|---|---|
| 2,446,099 | A * | 7/1948 | Niblack | 601/127 |
| 5,281,233 | A * | 1/1994 | Dolev | 606/133 |
| 5,916,222 | A * | 6/1999 | Iwasaki et al. | 606/133 |
| 5,976,157 | A * | 11/1999 | Yiu | 606/133 |
| 2005/0125008 | A1 * | 6/2005 | Poran | 606/133 |
| 2006/0271071 | A1 * | 11/2006 | Dorber et al. | 606/133 |
| 2007/0093853 | A1 * | 4/2007 | Poran | 606/133 |

FOREIGN PATENT DOCUMENTS

| | | | |
|---|---|---|---|
| DE | 4427788 | A1 * | 2/1996 |
| EP | 0 292 091 | A1 | 11/1988 |
| EP | 0 383 719 | A2 | 8/1990 |
| EP | 0 532 106 | A1 | 3/1993 |
| FR | 2 627 362 | A1 | 8/1989 |
| FR | 2 697 977 | A1 | 5/1994 |

* cited by examiner

*Primary Examiner* — Ryan Severson
*Assistant Examiner* — Rachel S Papeika
(74) *Attorney, Agent, or Firm* — Reinhart Boerner Van Deuren P.C.

(57) ABSTRACT

The present invention relates to an epilator comprising a holder and a deformable unitary epilating element prestressed into a curved configuration and mounted rotatably on said holder, said unitary element being made up of a plurality of adjacent discs connected together by spacers and hinge elements arranged in such a way as to form a pivot line for two adjacent discs which, when said unitary element is being used by being rotated, each pivot with their neighbor and form a diverging region where certain discs are parted from each other leaving open spaces, and a converging compression region where certain discs are pressed against each other, forming tweezers which pinch and remove the hairs from the skin.

13 Claims, 5 Drawing Sheets

MONOLITHIC EPILATOR

CROSS-REFERENCE TO RELATED PATENT APPLICATIONS

This patent application is the National Stage of International Application No. PCT/BE2007/000046, filed May 14, 2007, that claims the benefit of European Application No. 06447067.7, filed May 19, 2006, the entire teachings and disclosure of which are incorporated herein by reference thereto.

FIELD OF THE INVENTION

The present invention relates to a depilator and more particularly to a monolithic depilator, i.e. a depilator with a hair-removing element that is made of a single part.

STATE OF THE ART

Numerous manual or electric hair-removing devices are known and can be broadly classified into two main groups.

The first group is represented by spring depilators where a helical spring, usually bent, grips the hairs in the spaces between the coils and removes the hairs from the skin when the spaces between these coils are closed and compressed. This effect is obtained by bending the spring in different ways so that the spring thereby has a closed side (convergent side) and an open side (divergent side).

Hair-removing devices based on this principle are for example disclosed in FR-A-2627362, showing different ways of bending a spring in order to obtain a compression effect and thereby to remove hairs from the skin. When the hair-removing element is bent, a convergent zone is created where the coils are compressed against each other and a divergent zone is created with spaces between the coils.

The second group of hair-removing devices consists of depilators based on a plurality of adjacent discs as in EP-A-0 383 719 that shows a hair-removing device comprising a hair-removing element with adjacent discs separated by elements that cause these discs to swing and hence that transform them into hair-removing tongs. Such a hair-removing element comprises many parts, which renders it difficult to dismantle with a view to its thorough cleaning. In that respect, see in particular FIGS. 3, 4 and 5 of EP-A-0 383 719.

The major problem encountered with the prior art devices is in fact their cleaning since they are often used together with creams that quite quickly clog the spaces between the discs and are thus relatively difficult to clean. Devices with separate hair-removing discs must very frequently be completely dismantled in order to be properly cleaned, which is difficult or even impossible given the mechanical complexity and the many parts of some devices.

AIMS OF THE INVENTION

The present invention aims to overcome the drawbacks of the state of the art, and in particular to provide a hair-removing device with a monolithic hair-removing element where the plurality of adjacent discs and their interconnections or joints are manufactured in a single part. This design allows to create a hair-removing element that is disposable when it becomes difficult to clean. It will therefore be possible to replace this element several times a year to avoid the laborious cleaning work once the clogging reaches a certain level.

A second aim of the invention is to provide a simple hair-removing device that allows manufacture at a relatively low cost.

KEY

Figure 1:
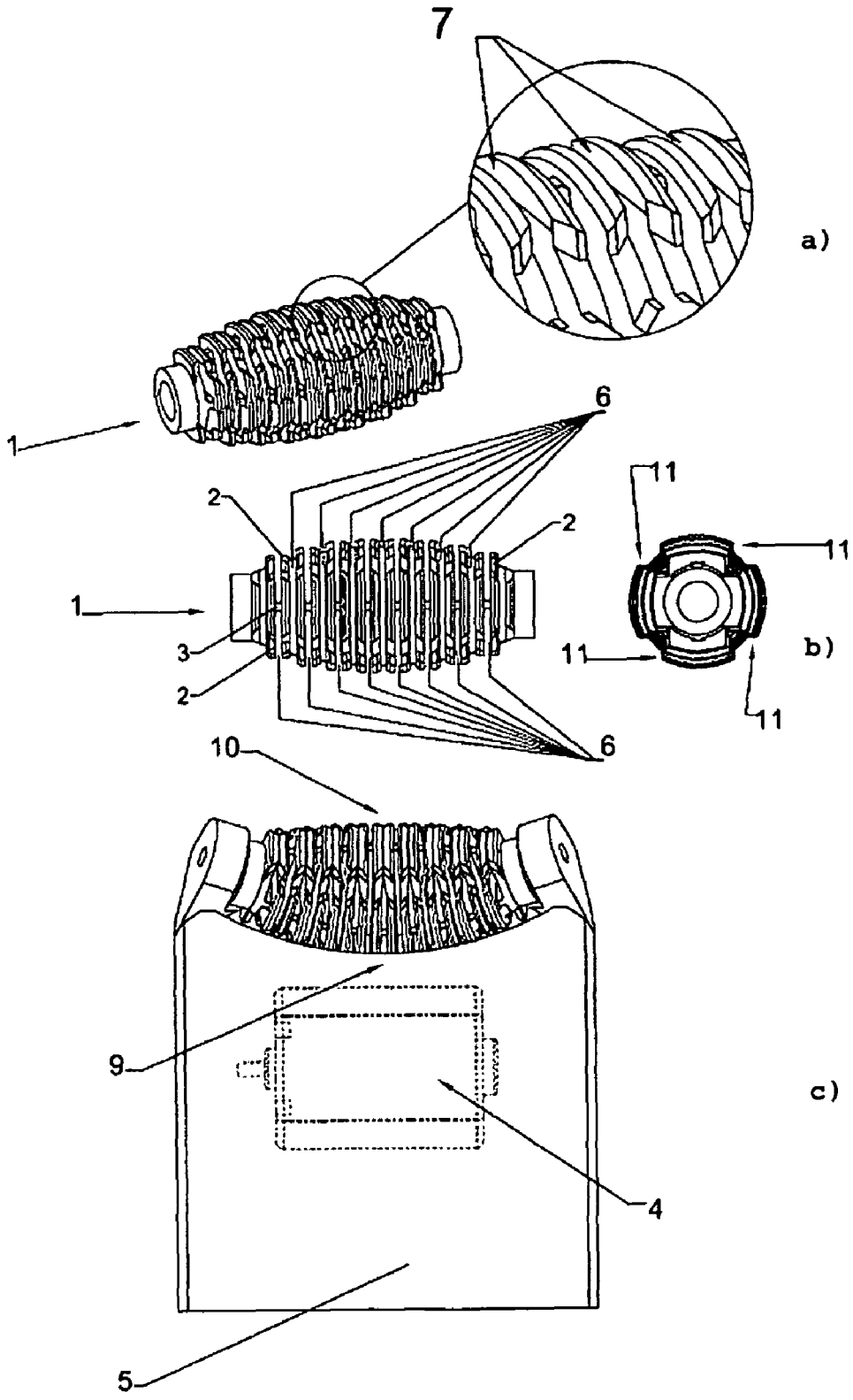
FIGS. 1*a* and 1*b* show different views of the monolithic hair-removing element with in particular a detailed view of the bevel 7 in FIG. 1*a*.
FIG. 1*c* shows the depilator as in the invention with the monolithic element pre-tensioned on its support and the possibility of locating a motor inside.
Figure 2:
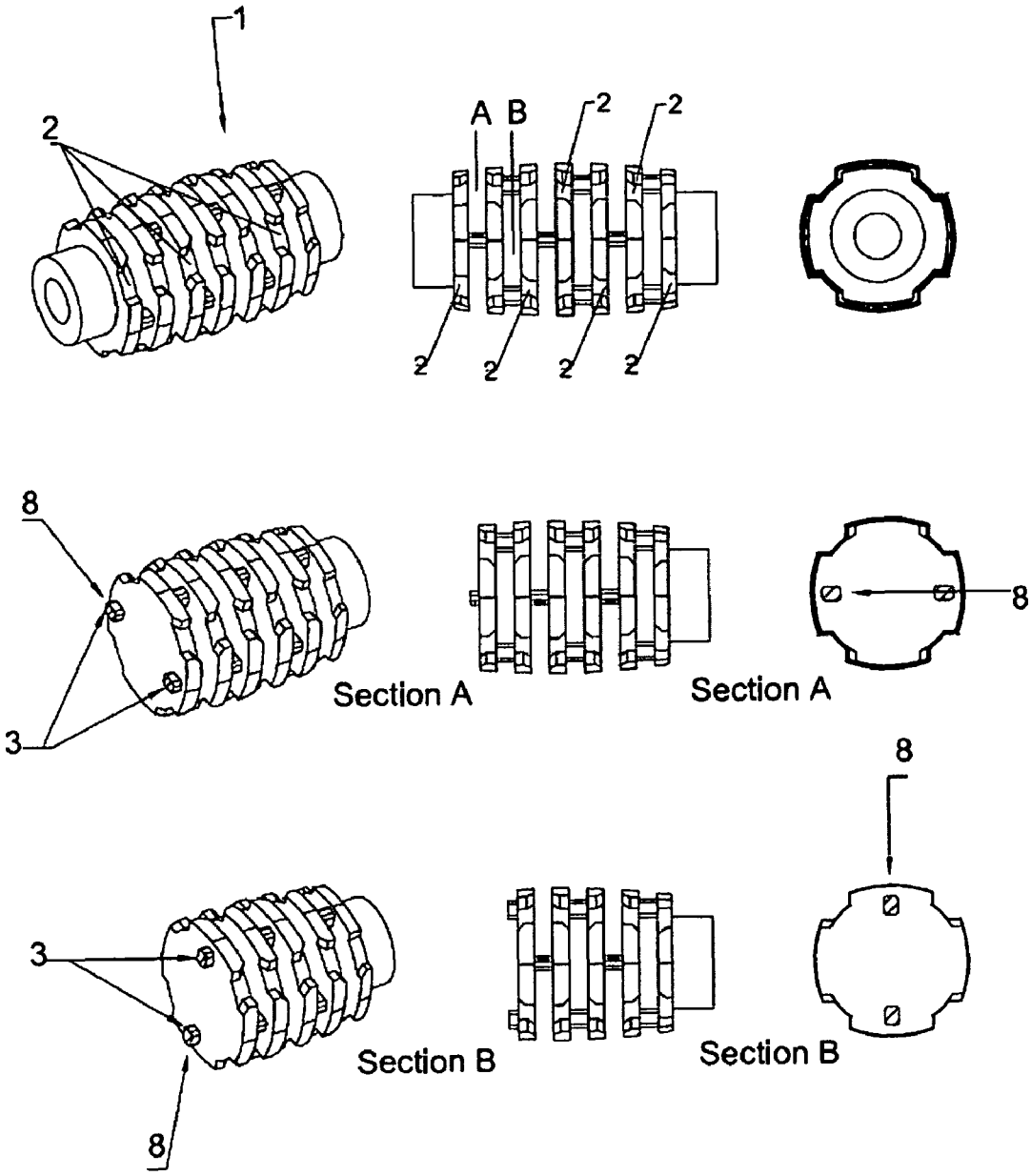
FIG. 2 shows the monolithic hair-removing element as in the invention where the spacing and jointing elements on the discs are represented by two protrusions essentially perpendicular to the discs, the protrusions being offset in each case by 90° relative to the adjacent discs. To improve clarity, the monolithic element was chopped up into various sections. The swinging-motion lines are represented by arrows (Ref. 8) on Sections A and B.
Figure 3:
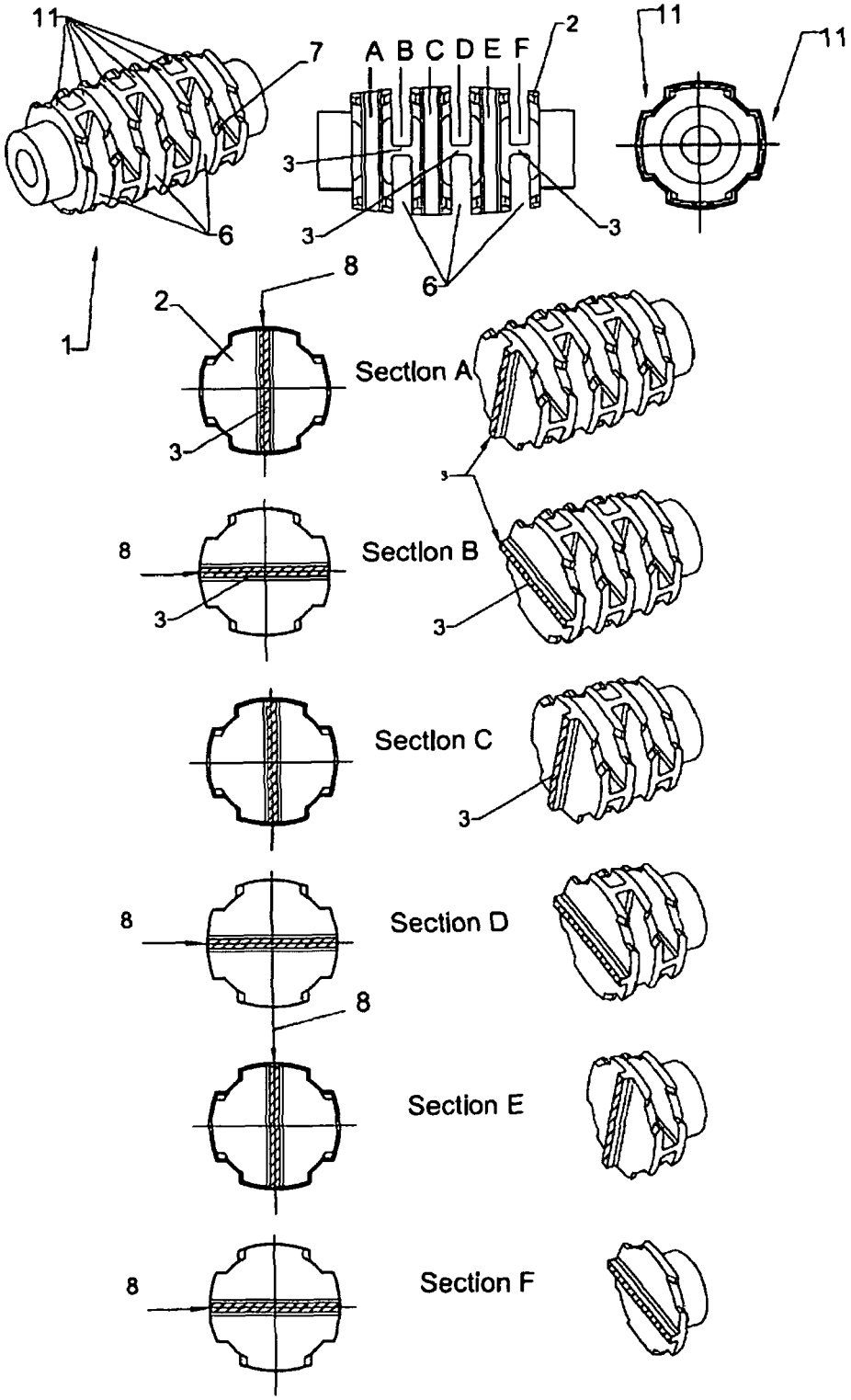
FIG. 3 shows the monolithic hair-removing element as in the invention where the spacing and jointing elements on the discs are represented by a protrusion across the entire diameter of the disc and passing through its centre. The protrusion also forms the swinging-motion line and its position is shown in Sections A to F.
Figure 4:
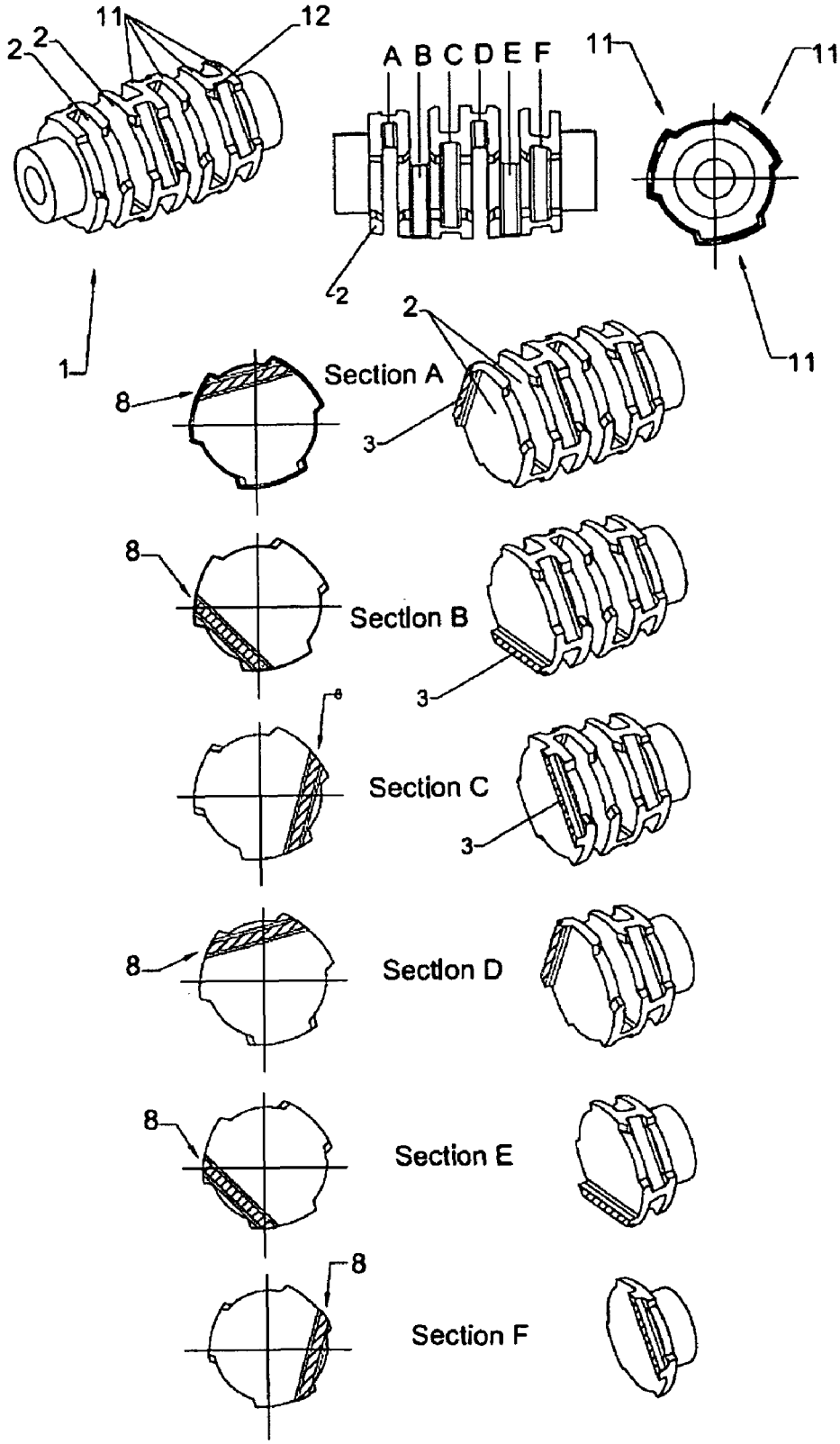
FIG. 4 shows the monolithic hair-removing element as in the invention where the spacing and jointing elements on the discs are represented by a protrusion that is offset relative to the discs and where the offset angle is also 90° relative to the adjacent discs.

1. Monolithic hair-removing element
2. Adjacent discs
3. Spacing and jointing elements
4. Motor
5. Support
6. Open space
7. Bevels (chamfers)
8. Swinging line
9. Divergent zone
10. Convergent compression zone
11. Specific geometrical protrusions

SUMMARY OF THE INVENTION

The present invention discloses a depilator comprising a support and a flexible monolithic hair-removing element pre-tensioned in a bent configuration and rotably mounted on said support, said monolithic element being formed by a plurality of adjacent discs, connected to each other by spacing and jointing elements arranged in such a way that they form a line of swinging line for two adjacent discs which, when said monolithic element is used by being rotated, swing in pairs and form a divergent zone, where some discs are separated from each other and leave open spaces, and a convergent compression zone, where some discs are pressed against each other and form tongs for gripping and removing hairs from the skin.

According to particular embodiments, the invention comprises one or more of the following features:

- The support also comprises a motor linked to said monolithic element and intended to impart a rotary motion to the latter when it is used, said rotary motion sliding it over the skin where the hair is to be removed, said rotary motion of said monolithic element causing the continuous motion of the discs from a separated orientation on the divergent side to a compression orientation on the convergent side in order to grip and remove the hairs from the skin; the regulation of the rotation speed is then controlled by the user for comfort of use;
- The discs comprise at their periphery segments with specific geometrical protrusions that are essentially parallel to said swinging line;
- The specific geometrical protrusions are adapted to a brushing and gripping sequence in the rotation direction of the disc;
- Said protrusions comprise at their periphery a bevel on each side that allows to create a gripping surface;
- Said spacing and jointing elements extend across the entire diameter of the discs;
- Said spacing and jointing elements are offset relative to the centre of the disc;
- Said spacing and jointing elements have an offset angle on two successive discs;
- The offset angle is between 45° and 120°;
- The offset angle is preferably 90°;
- The spacing and jointing elements comprise at least one protrusion essentially perpendicular to said discs;
- Said monolithic element is manufactured in synthetic material, preferably by an injection technique with thermoplastic material;
- Said monolithic element, before being pre-tensioned, has a concave, convex or cylindrical rotational geometry depending on the contact angle desired relative to the skin;
- Said discs comprise at their periphery a bevel on each side that allows to create a gripping surface in the case where the discs do not have protrusions;
- Said compression part in contact with the skin is concave, convex or rectilinear.

DETAILED DESCRIPTION OF THE INVENTION

The present invention discloses a depilator comprising a support for example in the form of a casing and a flexible monolithic hair-removing element 1. This depilator operates like those of the state of the art, namely it is compressed on one side so as to bend and create, for one thing, a compression part 10 where the discs 2 are pressed against each other and form tongs for removing the hairs from the skin, and, for another, a series of adjacent discs 2 separated by spaces in the divergent part 9 on the opposite side.

The discs 2 are connected to each other within this monolithic element 1 by jointing elements 3 that may take different forms and that are intended to swing a pair of discs 2 beyond a swinging line 8 during the rotation of said element and to switch them from the divergent position to the convergent position, i.e. to the state of compression where the discs form tongs in order to remove the hairs.

The monolithic hair-removing element 1 is preferably made of synthetic material and more particularly by injection of a thermoplastic material. Said element therefore has a certain flexibility which allows it to be compressed and to follow the bend given to it during its pretensioning and rotation.

Figure 5:
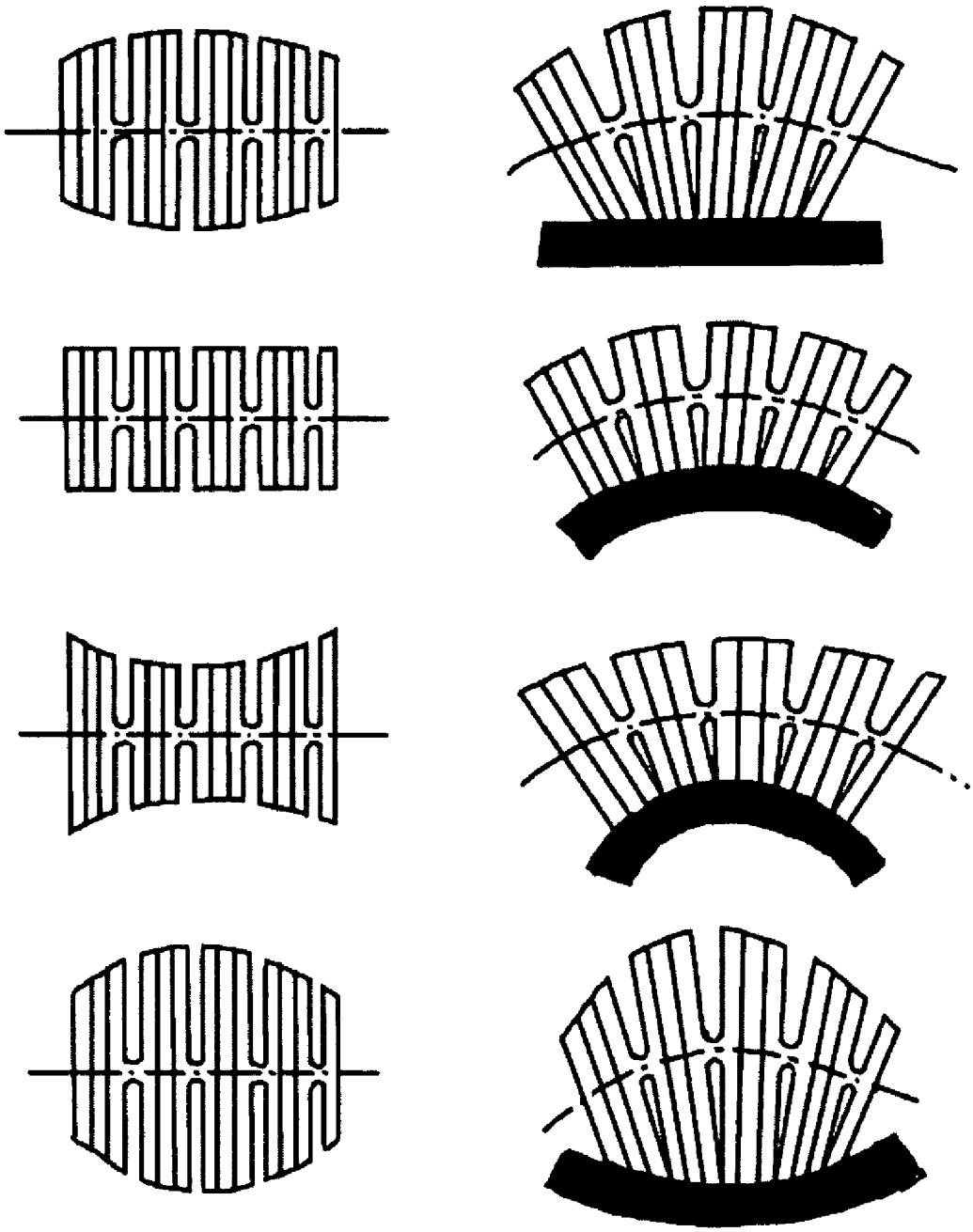
FIG. 5 shows the various options of contact angles between the monolithic hair-removing element and the skin depending on the initial shape of said element (concave, convex, more or less rounded, cylindrical).

Depending on the contact angle desired between the monolithic hair-removing element 1 and the skin, one should start with an element that is concave or convex or even cylindrical (see FIG. 5).

The main advantage of this monolithic element 1 lies in the fact that it can be an injected part made of a relatively cheap and therefore disposable synthetic material.

The basic structure of said hair-removing element comprises discs 2 but these discs may bear protrusions 11 with suitable geometrical shapes (recurrence of notches at regular intervals on the protrusions), which incidentally allow to grip or brush the hair before removal.

A bevel 7 may also be manufactured in some protrusions 11 located on the discs 2 in question so that they no longer form a point where the hair is gripped but rather a surface, which increases the effectiveness of the device (FIG. 1*a*—details).

These bevels 7 may also be manufactured on the discs themselves.

The adjacent discs of the monolithic element 1 generally swing in pairs by means of the joints 3 connecting said discs 2 to each other. These joints 3 may take a series of different forms in order to obtain this effect, one preferred embodiment being a protrusion that is essentially perpendicular to the disc. In a preferred embodiment of the invention, the jointing elements 3 are offset by 90° relative to each other, which allows to obtain an optimum number of tongs on the monolithic hair-removing element 1.

When the hair-removing element 1 is connected to a motor which rotates it more quickly than the speed at which said element sweeps over the skin, the depilator still becomes more effective. The offset angles between the joints 3 of the successive discs 2 are preferably 90° but they may in principle be between 45° and 120°; this offset angle will determine the number of discs 2 and thereby the number of tongs available for gripping the hairs in a particular position on the monolithic element 2 of the invention.

The invention claimed is:

1. Depilator comprising a support (5) and a flexible monolithic hair-removing element (1) pre-tensioned in a bent configuration and rotatably mounted on said support (5), said monolithic element being formed by a plurality of adjacent discs (2), connected to each other by spacing and jointing elements (3) with an offset angle (11) on two successive discs, said spacing elements being arranged in such a way that they form a swinging line (8) for two adjacent discs (2) which, when said monolithic element (1) is used by being rotated, swing in pairs and form a divergent zone (9) where some discs (2) are separated form each other and leave open spaces (6), and a convergent compression zone (10) where some discs (2) are pressed against each other and form tongs for gripping and removing hairs from the skin.

2. Depilator as in claim 1, wherein the support (5) also comprises a motor (4) linked to said monolithic element (1) and intended to impart a rotary motion to the latter when it is used, said rotary motion sliding said monolithic element over the skin where the hair is to be removed, said rotary motion of said monolithic element (1) causing a continuous motion of the discs (2) from a separated orientation in the divergent zone (9) to a compression orientation in the convergent compression zone (10) in order to grip and remove the hairs from the skin.

3. Depilator as in claim 1, wherein the discs (2) comprise at their periphery segments with specific geometrical protrusions (11) essentially parallel to said swinging line (8).

4. Depilator as in claim 3, wherein the specific geometrical protrusions (11) are adapted to a brushing and gripping sequence in the rotation direction of the discs (2).

5. Depilator as in claim 3, wherein said protrusions (11) comprise at their periphery a bevel (7) on each side which allows to create a gripping surface.

6. Depilator as in claim 1, wherein said spacing and jointing elements (3) extend across the entire diameter of the discs (2).

7. Depilator as in claim 1, wherein said spacing and jointing elements (3) are offset relative to the centre of the discs (2).

8. Depilator as in claim 1, wherein the offset angle is between 45° and 120°.

9. Depilator as in claim 8, wherein the offset angle is 90°.

10. Depilator as in claim 1, wherein said monolithic element (1) is made of synthetic material.

11. Depilator as in claim 1, wherein said monolithic element (1), before it is pre-tensioned, has a concave, convex or cylindrical rotational geometry.

12. Depilator as in claim 1, wherein said discs comprise at their periphery a bevel (7) on each side that allows to create a gripping surface.

13. Depilator as in claim 1, wherein said convergent compression zone (10) in contact with the skin is concave, convex or rectilinear.

* * * * *